US006577740B1

(12) United States Patent
Bordewijk

(10) Patent No.: US 6,577,740 B1
(45) Date of Patent: Jun. 10, 2003

(54) HEARING AID, EAR PIECE, AID FOR ITS INSERTION INTO THE EAR AND DEVICE FOR MAKING A CAST OF THE DEEPEST PART OF THE AUDITORY PASSAGE

(76) Inventor: Lourens George Bordewijk, Wassenaarseweg 11B, Den Haag (NL), NL-2596 CE ( * ) Notice: Subject to any disclaimer, the term of this patent is extended or adjusted under 35 U.S.C. 154(b) by 0 days.

(21) Appl. No.: 09/508,163

(22) PCT Filed: Sep. 8, 1998

(86) PCT No.: PCT/NL98/00517

§ 371 (c)(1),
(2), (4) Date: Mar. 8, 2000

(87) PCT Pub. No.: WO99/13686

PCT Pub. Date: Mar. 18, 1999

(30) Foreign Application Priority Data

Sep. 8, 1997 (NL) ..... 1006962
Oct. 13, 1997 (NL) ..... 1007257

(51) Int. Cl.[7] ..... H04R 25/00
(52) U.S. Cl. ..... 381/323; 381/324
(58) Field of Search ..... 381/312, 322, 381/323, 324, 328, 380; 181/129, 130, 135

(56) References Cited

U.S. PATENT DOCUMENTS 2,959,645 A * 11/1960 Ladd ..... 381/323
3,890,474 A 6/1975 Glicksberg
4,628,907 A 12/1986 Epley
5,003,607 A 3/1991 Reed
5,381,484 A 1/1995 Claes et al.

FOREIGN PATENT DOCUMENTS

EP 0 517 322 12/1992
EP 0 684 749 11/1995
WO WO 98/20704 5/1998

OTHER PUBLICATIONS

Bryant et al., "Minimal Contact Long Canal ITE Hearing Instruments", *Hearing Instruments,* Jan. 1991, pp. 12–15 and 48.

Staab et al., "A Fitting Rationale for Deep Fitting Canal Hearing Instruments", *Hearing Instruments,* Jan. 1991, pp. 6, 8–10 and 48.

* cited by examiner

*Primary Examiner*—Rexford Barnie
*Assistant Examiner*—Phylesha Dabney
(74) *Attorney, Agent, or Firm*—Young & Thompson

(57) ABSTRACT

Hearing aid for placement in an ear includes a carrier, an enclosure, a microphone, a battery and a speaker. The carrier carries the battery and the enclosure has a microphone entrance. The enclosure envelopes the microphone, the battery and the speaker and is connected to the carrier. The enclosure has a first and a second end, the first end being directed to the outside and the second end being directed into the ear when placed in the ear. The carrier is situated between the first and the second end and the enclosure decreases in diameter from the carrier towards the first end.

32 Claims, 4 Drawing Sheets

HEARING AID, EAR PIECE, AID FOR ITS INSERTION INTO THE EAR AND DEVICE FOR MAKING A CAST OF THE DEEPEST PART OF THE AUDITORY PASSAGE

BACKGROUND OF THE INVENTION

The present invention relates to a hearing aid for placement in an ear comprising a carrier means, an enclosure, a microphone, a battery, an amplifier and a speaker, the carrier means carrying the battery and said enclosure having a microphone entrance and surrounding the microphone, the battery and the speaker and being connected to the carrier means.

Such a hearing aid is known from the European patent application 0 517 322 A2. This known hearing aid which is to be placed in the ear, has a carrier means, also called faceplate, which carries the electronics of the hearing aid including the speaker. This carrier means, when the hearing aid is placed in the ear, is situated on the outside of the hearing aid which is directed to the outside of the ear, and when placed in the ear is the part of the hearing aid having the largest diameter. The carrier means namely first of all is important for the fixation of the battery drawer. Because the battery is the largest part, the hearing aid usually has the largest diameter at the location of the carrier means. Although such a hearing aid generally performs well, problems may arise when the hearing aid can be produced increasingly smaller and therefore can be placed deeper, which problems as appeared after lengthy examinations are the result of the fact that such a hearing aid placed thus deep in the ear cannot record the movements of the auditory passage well. When one goes from the outside to the inside of the ear, then the first part of this auditory passage is surrounded by so-called jaw heads. The auditory passage itself consists of elastic cartilage. The jaw heads change into scull bone which is rigid. The auditory passage finally ends near the eardrum. The known hearing aid of the kind which is placed deep in the auditory passage, appears to be placed thus in the auditory passage that the carrier means is placed at the location of the jaw heads. These jaw heads move together with the jaws, as a result of which mainly during chewing movements the pressure on the hearing aid is constantly changed, which causes an unpleasant feeling with the wearer of a hearing aid. Furthermore during these chewing movements, acoustic leakage, the so-called whistling, may occur.

SUMMARY OF THE INVENTION

Among others it is an objective of the present invention to provide a hearing aid for placement in an ear, with which the above-mentioned problems are reduced or even entirely removed.

For that purpose a hearing aid of the kind mentioned above is according to the invention characterized in that, the enclosure has a first and a second end, the first end being directed to the outside and the second end being directed into the ear when placed in the ear, in that the carrier means is situated between the first and the second end and that the enclosure of the carrier means decreases in diameter towards the first end. In this way the elastic forces in the auditory passage may press down the device inwardly, the carrier means having the largest diameter of the hearing aid when placed in the ear, being placed more to the centre of the device, because of which the elastic forces can be better used and contact with the moving jaw heads is prevented. This improves the wearing comfort of the hearing aid and reduces the whistling or even removes it entirely. Contrary to the up until now common idea that a hearing aid has to close off the auditory passage wherever possible and therefore over its entire length for an optimum result, this is not the case with a hearing aid according to the present invention. With less contacting surface a good closing off is still obtained.

Although the carrier means may consist of one part, it has manufacturing and user technical advantage when the carrier means contain a first and a separate second carrier element, which are placed adjacent to one another and are connected carrier elements, the first carrier element being situated closer to the first end and the second carrier element being situated closer to the second end.

Here at least one of the carrier elements can be designed as a carrier plate or at least one of the carrier elements can be designed as a carrier ring which can be closed or not, the first and the second carrier element being made of different materials.

Preferably the enclosure comprises a first enclosure part and a second enclosure part, the first enclosure part being connected to the first carrier element and the second enclosure part being connected to the second carrier element. In this way the user-friendliness of the hearing aid can be enhanced, and the first enclosure part and the second enclosure part can be manufactured of different materials to adjust the hearing aid better to the various characteristics of the auditory passage.

Preferably the first and outer enclosure part is manufactured of hard material and the second enclosure part is manufactured of soft material.

If the speaker is placed next to the battery, when seen in a direction from the first to the second end, an extremely short length of the hearing aid is obtained, because of which the second end of the enclosure can be placed closer to the eardrum, which entails significant advantages.

According to another aspect of the invention an ear piece is provided for placement in an ear comprising a carrier means and an enclosure, in which the enclosure has an opening for receiving a sound hose and is connected to the carrier means, characterized in that, the enclosure has a first and a second end, the first end being directed to the outside and the second end being directed into the ear when placed in the ear, in that the carrier means is situated between the first and the second end and that the enclosure of the carrier means decreases in diameter towards the first end. Such an ear piece can be used in combination with a hearing aid part which is to be placed behind the auricle, also called ear drop. An ear piece normally does not contain a speaker, although it is possible all the same, and is connected to the ear drop via the sound hose. The speaker can therefore also be placed in that part of the hearing aid and the parts are connected by the sound hose.

According to a further aspect of the present application an aid is provided for inserting a hearing aid (or ear piece) according to the invention into the ear. Such an aid is advantageous as the hearing aid and the ear piece according to the invention can be inserted deeper into the auditory passage than the known devices.

According to a further aspect of the invention a device is provided for making a cast of the deepest part of the auditory passage, which device is provided with:

- a supply hose for supplying a casting material to the deepest part of the auditory passage from outside of the ear, which supply hose is provided with a supply end for casting material and a discharge end for discharging casting material to the deepest part of the auditory passage;

a truncated conical ring of soft elastic material, which ring is arranged around the discharge end of the supply hose;

a foil placed over the ring; and a cord placed over the foil which cord is provided with a thickening for pressing the foil in the discharge end of the supply hose. With this device it is possible to insert casting material very close to the eardrum in the auditory passage without damaging the eardrum or the sensitive parts of the auditory passage surrounding it.

BRIEF DESCRIPTION OF THE DRAWINGS

Some embodiments of the hearing aid, an ear piece, an aid for its insertion into the ear and a device for making a cast of the deepest part of the auditory passage according to the invention will below be shown by way of example on the basis of the drawing, in which.

DESCRIPTION OF THE PREFERRED EMBODIMENTS

Figure 1:
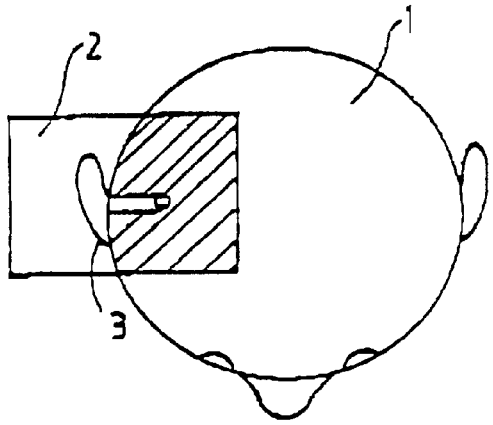
FIG. 1 schematically shows an auditory passage in a human head.
Figure 2:
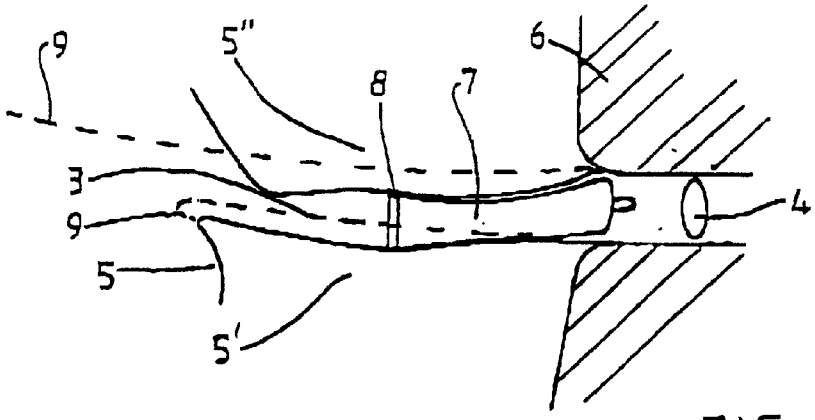
FIG. 2 schematically shows a blown-up picture of an auditory passage with a conventional hearing aid placed in it.

FIG. 1 schematically shows an auditory passage 3 of a right ear 2 in a human head 1. This auditory passage 3 is schematically shown in a blown-up fashion in FIG. 2, in which auditory passage 3 a conventional hearing aid 7, 8 has been placed. In FIG. 2, 4 indicates the eardrum, 5 the facial skin, 5' and 5" the jaw heads, and 6 the skull bone, and the dotted lines 9 by approximation indicate the position of the rear side of the auditory passage 3, when the auricle is pulled, as a result of which the auditory passage 3 is widened. A carrier means 8 of the conventional hearing aid 7 appears to be situated at the location of the jaw heads 5', 5", because of which the problems described above may arise.

Figure 3:
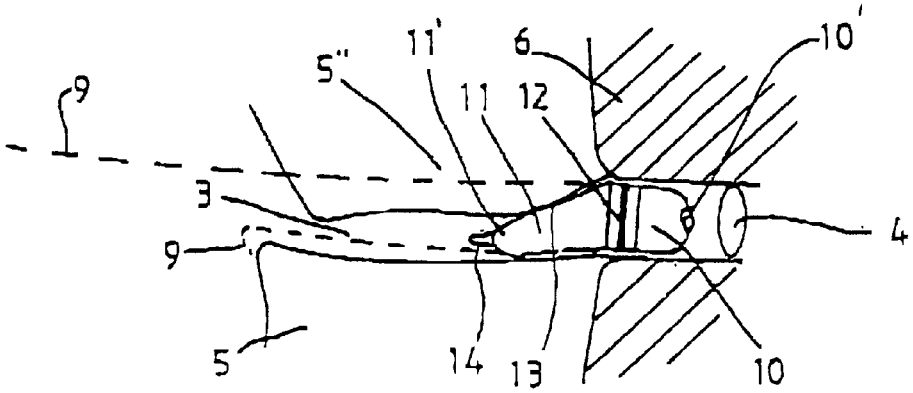
FIG. 3 schematically shows a blown-up picture of an auditory passage with a hearing aid according to the invention placed in it.

FIG. 3 schematically shows a blown-up picture of the auditory passage 3 of FIG. 2, in which however an exemplary embodiment of a hearing aid 10, 11, 12, 14 according to the invention has been arranged in the auditory passage 3. In this exemplary embodiment , which will be further elucidated hereafter, the carrier means comprises two carrier elements which abut each other at the location of reference number 12. In stead of two carrier elements, the carrier element can also consist of merely one part. The carrier elements are at the level of the beginning of the skull bone 6. An enclosure 10, 11 has a first 11' (in which a microphone entrance 14 has been arranged) and a second end 10', the first end 11' being directed to the outside and the second end 10' being directed into the ear. It can clearly be seen that the carrier means is situated between the first 11' and the second end 10' and that the enclosure 10, 11 of the carrier means decreases in diameter towards the first end 11'. In this way the elastic auditory passage presses the hearing aid towards the eardrum 4 near 13. In reality the diameter of the auditory passage continuously decreases towards the eardrum. The device therefore presses itself down. Because the carrier means is centrally situated in the hearing aid and largely beyond the jaw heads, the movements of the jaw heads 5', 5" are not transferred to the hearing aid and the hearing aid keeps closing off the auditory passage at the location of 13 and 6. Although not shown the first end may contain a support plate on which the microphone and/or the volume control are attached.

Figure 4:
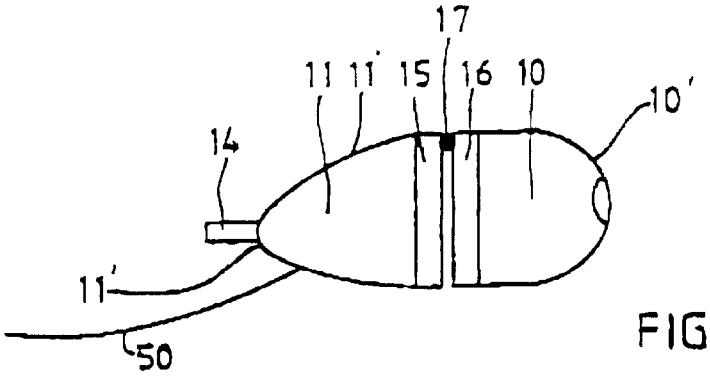
FIG. 4 schematically shows a view of the hearing aid according to the present invention with two hinge-wise connected carrier elements.

In FIG. 4 a view is schematically shown of a hearing aid according to the present invention with two hinge-wise connected carrier elements 15 and 16 at the location of 17. Other connections of carrier elements are also possible, such as for instance the connection as described hereafter with reference to FIGS. 8 and 9. Here the first carrier element 15 is situated more closely to the first end 11' and the second carrier element 16 is situated more closely to the second end 10'. At least one of the carrier elements can be formed by a support plate, and/or at least one of the carrier elements can be formed by a carrier ring. In the shown exemplary embodiment the enclosure 11 of the first carrier element 15 decreases in diameter towards the first end 11', preferably conically, so that the elastic auditory passage presses the hearing aid to the inside. Preferably the part decreasing conically in diameter towards the first end 11' of the enclosure has an oblique surface 11", preferably adjusted to the shape of the part of the auditory passage concerned of the person for whom the hearing aid is meant, for sufficiently pressing down against the elastic tissue of the auditory passage when placing in the ear.

In the shown exemplary embodiment the enclosure comprises a first enclosure part 11 and a second enclosure part 10, the first enclosure part 11 being connected to the first carrier element 15 and the second enclosure part 10 being connected to the second carrier element 16, which is both manufacturing and user technically advantageous. On the other hand the enclosure might very well consist of one single enclosure.

Figure 5:
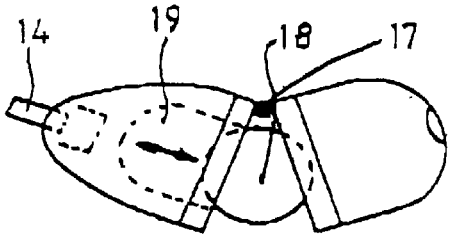
FIG. 5 schematically shows the hearing aid according to FIG. 4 in which the placement of the battery is shown.

In FIG. 5 carrier elements 15, 16 are shown hinged around hinge 17, because of which placement of a battery 18 in a battery drawer 19 is possible. Of course other embodiments for inserting a battery are possible too.

In the embodiment shown in FIGS. 3 and 4, the enclosure part 10 is made of soft material, for instance silicones. On the other hand the enclosure part 11 is made of a hard material in order to sufficiently protect the electronics accommodated in there. Also the carrier elements can if so desired be made of different materials.

Figure 6:
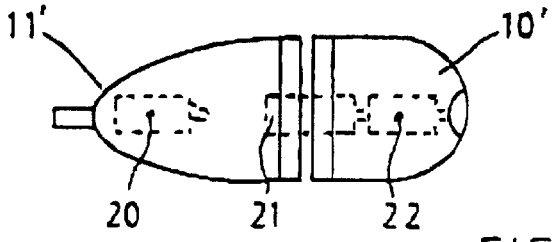
FIG. 6 schematically shows the hearing aid according to FIG. 4 in which all possible placements of the speaker are shown.

In the enclosure of the hearing aid among others a battery, a microphone and a speaker are accommodated. FIG. 6 schematically shows the various possibilities for placement of one of these parts in the hearing aid. In the position indicated by 20 the speaker is placed near the microphone, a hose which is not shown, transporting the sound from the enclosure to the eardrum. In the position indicated by 21 the speaker is placed adjacent to the battery, in which way an extremely short length for the hearing aid is obtained. In this way the hearing aid can be so small that it is hardly visible from the outside of the ear. In the position indicated by 22 the speaker is placed near the second end 10' of the enclosure.

Figure 7:
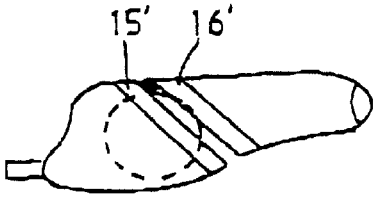
FIG. 7 schematically shows a view of an alternative hearing aid according to the present invention with two hinge-wise connected carrier elements.

In FIG. 7 a view of an alternative hearing aid according to the present invention is schematically shown, in which the two hinge-wise connected carrier elements 15', 16' are placed at an angle, This is a suitable embodiment in a very small auditory passage in depth.

Figure 8:
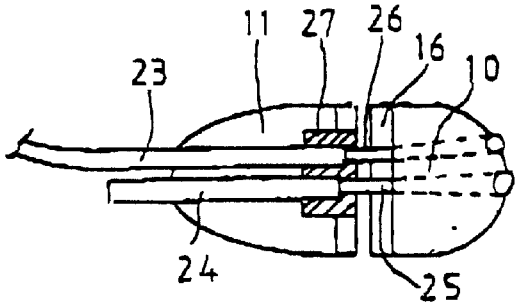
FIG. 8 schematically shows a view, partially in cross-section, of an ear piece for placement in an ear according to the present invention.
Figure 9:
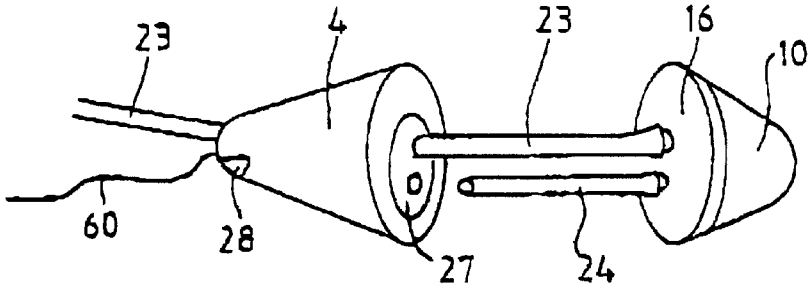
FIG. 9 schematically shows the ear piece of FIG. 8 in a partly disassembled state.

FIG. 8 schematically shows in view and partially in cross-section, an ear piece for placement into the ear according to the present invention. This ear piece is connected via a sound hose 23 to a hearing aid part which is to be arranged behind the auricle. The first of the carrier elements 15 is provided with an opening for receiving an elastic fitting piece 27, for instance rubber, in which fitting piece 27 a first passage for a sound hose 23 has been arranged. The second of the carrier elements 16 is provided with a first sleeve 26 for arranging a sound hose 23 over it. The fitting piece 27 may be provided with a second passage for a ventilation hose 24, the second 16 of the carrier elements being provided with a second sleeve 25, for arranging a ventilation hose 24 over it. The rubber fitting piece 27 ensures that no leakage of sound can take place to the outside from the space between the carrier elements and also ensures that the carrier elements remain tightly connected. However, for changing the sound hose or the ventilation hose it will no longer be necessary that the carrier elements with the accompanying enclosure parts will have to be pulled apart, as is schematically shown in FIG. 9, in which 28 is the opening for the ventilation hose.

Figure 10:
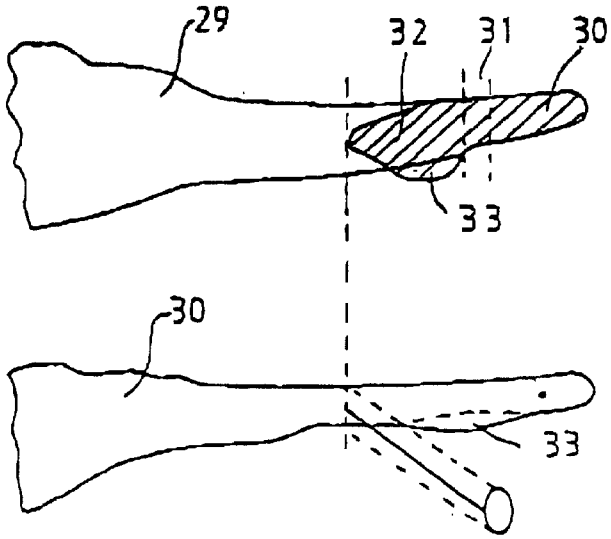
FIG. 10 schematically shows the making of a cast of the deepest part of the auditory passage.

On the basis of FIG. 10 the making of a cast of the deepest part of the auditory passage will be schematically described. With 29 a deep or complete cast of an auditory passage is shown, while it may be enlarged if so desired, by pulling the auricle. On the basis of the minimal dimensions of the battery drawer and the perceived place of transition to the skull bone, which can be recognized on the cast, a suitable location 31 is chosen to place the carrier elements. First the cast part needs to be pointed before the, for instance hard, first enclosure part can be made from it. Cast 29' shows the auditory passage in repose and this cast gives an auxiliary dimension for the treatment of 32. It is endeavoured to keep 32 as short as possible. With 33 a space in repose is shown which disappears when pulling out. The cast may be thickened a little here if so desired. Particularly in the bony part the auditory passage is elliptic, which usually facilitates the placement in vertical direction of the usually long and narrow battery drawer.

The pressing force in the auditory passage is particularly active in the horizontal plane (head thought straight), because of which the battery is no impediment to reduce the width of the device in the horizontal plane to accommodate the auditory passage wall and optimally utilize this pressing force.

In the manufacturing of the second enclosure part, analogous to the known techniques for the so-called "stick"-ear pieces, the deepest 20 cm of the cast is taken as a starting point. In the transparent negative taken from the cast, in fact a transparent copy-auditory passage made of gel material, a model is placed of the smallest possible second carrier element with the accompanying electronics. By now injecting the remainder of the mould with silicon material the soft second enclosure part is made which is, as it were, grouted and thus perfectly suits the rest of the device, Removal of the hearing aid can simply take place by means of thread (for instance 60 in FIG. 9 and 50 in FIG. 4), for instance a nylon thread. As the hearing aid/ear piece according to the present invention can be inserted close to the eardrum, it is advantageous when an aid for inserting a hearing aid or ear piece into the ear is provided. In an advantageous manner this aid comprises a hollow tube-shaped element which can be placed over the thread. The tube-shaped element, for instance a hard hollow tube or little rod, is slid over the thread and is pressed together on the thread when inserting. After insertion this hollow tube or little rod is removed. This aid is safe as cannot shoot out because of the fact that the thread determines a contact point on the device. Alternatively the aid for inserting a hearing aid or ear piece into the ear can be formed by a little pressure rod which can be placed in the microphone entrance (for instance entrance 14 in FIG. 4). This alternative embodiment has the accompanying advantage that the microphone entrance is acoustically closed off during this insertion and that as a result of that the device during the insertion does not whistle annoyingly.

Figure 11:
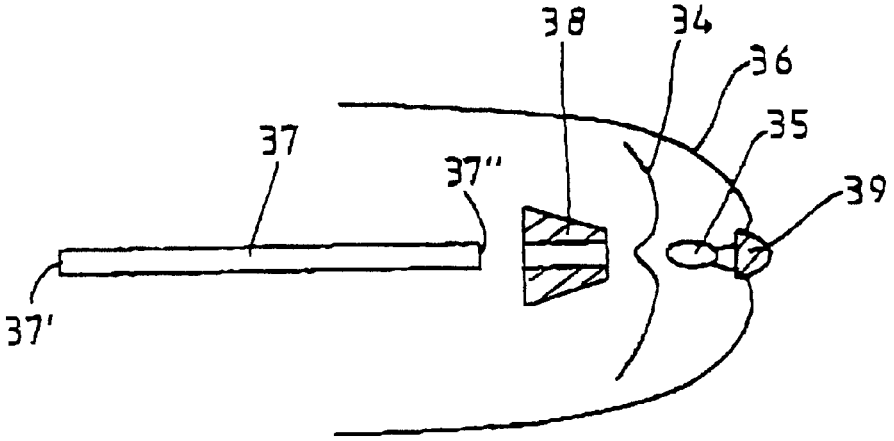
FIG. 11 schematically shows in view the parts of a device for making a cast of the deepest part of the auditory passage in a disassembled state.
Figure 12:
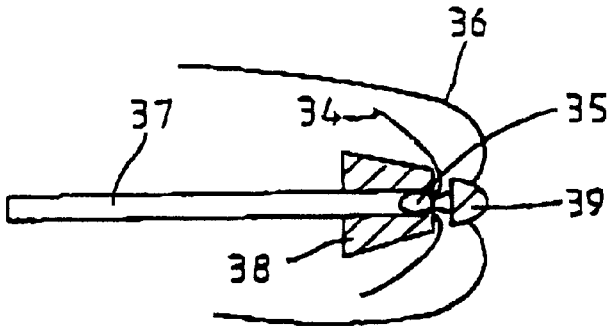
FIG. 12 schematically shows in view a device for making a cast of the deepest part of the auditory passage in an assembled state.
Figure 13:
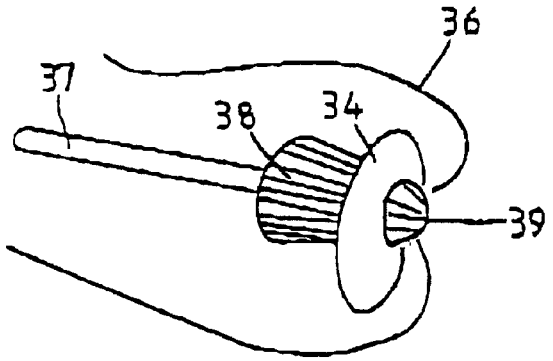
FIG. 13 schematically shows in perspective a device for making a cast of the deepest part of the auditory passage in an assembled state.

FIG. 11 schematically shows a view of the parts of a device for making a cast of the deepest part of the auditory passage in disassembled state, whereas FIG. 12 shows the assembled state and FIG. 13 shows the perspective of it. This device is provided with a supply hose 37 for supplying a casting material to the deepest part of the auditory passage from outside of the ear. The supply hose 37 is provided with a supply end 37' for casting material and a discharge end 37" for discharging casting material to the deepest part of the auditory passage. A truncated conical ring 38 of soft elastic material, for instance foam rubber, is arranged around the discharge end 37" of the supply hose 37. A foil 34 is placed over the ring 38. A cord 36 is placed over the foil 34 which cord is provided with a thickening 35 or knot for pressing the foil 34 in the discharge end 37" of the supply hose 37. The device is furthermore provided with an eardrum protection 39, for instance a tip of rubber which remains in its place because of the two pierced ends of the cord. The foil preferably has the shape of a so-called 'finger condom', and therefore more or less has the elongated umbrella or parachute shape. A foil of this shape and with a length of approximately 3 cm and a cross-section of approximately 1 cm appears to be extremely suitable to prevent material from dripping along the foil. Alternatively the foil could for instance also be disc-shaped. If so desired a ventilation hose can be attached to the cord. This device prevents the problem of casting material coming too close to or against the eardrum. The foil 34 can during insertion into the ear be kept in its place by the cord 36. Subsequently the casting material is supplied via the supply hose 37. The pressure is such that the foil 34 with the thickening 35 is pressed out of the discharge end 37". The foil 34 here ensures that the casting material cannot come near the eardrum. After the casting material has cured, the whole is taken from the ear, the foil usually sticking to the casting material and in any case being pressed against the casting material by the cord. In this way it is always guaranteed that the foil can be removed from the ear.

Besides in the art of the hearing aid the invention can also be used in passive or active sound mufflers, ear telephones, ear microphones and the like. Signal connections via sound hose, electric conduction, fibre-optic or via radio connection between ear piece and the parts placed outside the auditory passage are conceivable. The invention makes it possible to reduce the diameter of the sound hose with parts placed behind an ear because the necessary power is smaller, as the ear piece can be placed closer to the eardrum. This has a great cosmetic advantage. A second adaption as a result of the invention is that the microphone entrance of behind-the-ear hearing aids can be brought closer to the auditory passage because of the smaller whistling tendencies as a result of the smaller electric amplifications. This results in the sound received by the auricle being better focused and that the use of a telephone, telephone receiver becomes easier as the speaker of the telephone, contrary to the hearing aids known up until now, can just be pressed against the auricle. The latter facilitates the use of the telephone.

Although the hearing aid according to the invention has been described above as provided with a microphone, a battery, an amplifier and a speaker, it is also possible because of the present invention that other elements are accommodated in the hearing aid. For instance separate amplifiers or digital amplifiers can be accommodated in the hearing aid as well. Furthermore the carrier means of the hearing aid according to the present invention apart from the battery possibly also carries the speaker. The invention thus provides the following advantages: the hearing aid/ear piece is less prone to problems with jaw heads/dynamics of the mouth, the hearing aid/ear piece clamps itself fixed in the auditory passage because of the elastic force in the auditory passage which is usefully utilized, and the hearing aid/ear piece has an effective way of construction which is very small (speaker next to battery) with unprecedented efficient filling of space. Thus a hearing aid/ear piece which can be worn close to the eardrum (with all its acoustic advantages) is possible in practice. There is however another additional advantage. Not every custom-made hearing aid for a certain auditory passage can also be worn in practice. The auditory passage after all has a complicated structure. A hearing aid which exactly fits in the say last 1.5 cm of a auditory passage of 3 cm long, has to reach that place via turns and narrows. Often even a rotation about the Iongitudinal axis of the hearing aid during the movement to the inside is part of this. Because of the unique design an compact construction of the hearing aid/ear piece according to the present invention (rounded off with a decreasing diameter towards both ends and significantly less touch contact with the auditory passage) the manoeuvring when putting in is much more simple and it is possible in practice to place a hearing aid/ear piece which is worn deep.

What is claimed is:

1. Hearing aid for placement in an auditory passage of an ear, comprising:

a carrier means, an enclosure, a microphone, a battery, an amplifier and a speaker, the carrier means carrying the battery and said enclosure having a microphone entrance and surrounding the microphone, the battery and the speaker and being connected to the carrier means, wherein the enclosure has a first and a second end, the first end being directed to the outside and the second end being directed into the ear when placed in the auditory passage of the ear, in that the carrier means is situated between the first and the second end and that the enclosure decreases in diameter towards the first end, wherein the carrier means contains a first and a separate second carrier element, which are placed adjacent to and connected to one another, the first carrier element being situated closer to the first end and the second carrier element being situated closer to the second end, and wherein the first of the carrier elements is provided with an opening for receiving an elastic fitting piece, in which fitting piece a first passage for a sound hose is arranged, and in that the second of the carrier elements is provided with a first sleeve for arranging a sound hose over it.

2. Hearing aid according to claim 1, characterized in that, at least one of the carrier elements is a carrier plate.

3. Hearing aid according to claim 1, characterized in that, at least one of the carrier elements is a carrier ring.

4. Hearing aid according to claim 1, characterized in that, the carrier elements are connected to each other hinge-wise.

5. Hearing aid according to claim 1, characterized in that in the fitting piece a second passage is provided for a ventilation hose, and in that the second of the carrier elements is provided with a second sleeve for arranging a ventilation hose over it.

6. Hearing aid according to claim 5, characterized in that, the hearing aid is further provided with a ventilation hose which extends through the second passage and is arranged around the second sleeve.

7. Hearing aid according to claim 1, characterized in that, the first and the second carrier element are manufactured of different materials.

8. Hearing aid according to claim 1, characterized in that, that the enclosure comprises a first enclosure part and a second enclosure part, the first enclosure part being connected to the first carrier element and the second enclosure part being connected to the second carrier element.

9. Hearing aid according to claim 8, characterized in that, the first enclosure part decreases conically in diameter towards the first end.

10. Hearing aid according to claim 9, characterized in that, the first enclosure part has an oblique surface for abutting the elastic tissue of the ear when placed in the ear.

11. Hearing aid according to claim 8, characterized in that, the first enclosure part and the second enclosure part are manufactured of different materials.

12. Hearing aid according to claim 11, characterized in that, that the first enclosure part is manufactured of hard material and the second enclosure part is manufactured of soft material.

13. Hearing aid according to claim 1, characterized in that, in a direction from the first to the second end the speaker is placed next to the battery.

14. Hearing aid according to claim 1, characterized in that, the hearing aid is provided with means for removing the hearing aid from the ear.

15. Hearing aid according to claim 14, characterized in that, the means are a thread attached to the enclosure.

16. Hearing aid according to claim 1, characterized in that, the first end of the enclosure is provided with a support plate.

17. Hearing aid according to claim 16, characterized in that, the microphone is attached to the support plate.

18. Ear piece for placement in an auditory passage of an ear comprising:

a battery carrier means carrying the battery and an enclosure in which the enclosure has an opening for receiving a sound hose and is connected to the carrier means, wherein the enclosure has a first and a second end, the first end being directed to the outside and the second end being directed into the ear when placed in the auditory passage of the ear, in that the carrier means is situated between the first and the second end and that the enclosure decreases in diameter towards the first end, wherein the first of the carrier elements is provided with an opening for receiving an elastic fitting piece, in which fitting piece a first passage for a sound hose has been arranged, and in that the second of the carrier elements is provided with a first sleeve for arranging a sound hose over it.

19. Ear piece according to claim 18, characterized in that, the carrier means contains a first and a separate second carrier element, which are placed adjacent to and connected to one another, the first carrier element being situated closer to the first end and the second carrier element being situated closer to the second end.

20. Ear piece according to claim 19, characterized in that, at least one of the carrier elements is a carrier plate.

21. Ear piece according to claim 19, characterized in that at least one of the carrier elements is a carrier ring.

22. Hearing aid according to claim 18, characterized in that the carrier elements are connected to each other hinge-wise.

23. Ear piece according to claim 18, characterized in that in the fitting piece a second passage is provided for a ventilation hose, and in that the second of the carrier elements is provided with a second sleeve for arranging a ventilation hose over it.

24. Ear piece according to claim 23, characterized in that, that the hearing aid is further provided with a ventilation hose which extends through the second passage and is arranged around the second sleeve.

25. Ear piece according to claim 18, characterized in that, the first and the second carrier element are manufactured of different materials.

26. Ear piece according to claim 18, characterized in that, that the enclosure comprises a first enclosure part and a second enclosure part, the first enclosure part being connected to the first carrier element and the second enclosure part being connected to the second carrier element.

27. Ear piece according to claim 26, characterized in that the first enclosure part decreases conically in diameter towards the first end.

28. Ear piece according to claim 27, characterized in that, the first enclosure part has an oblique surface for abutting the elastic tissue of the ear when placed in the ear.

29. Ear piece according to claim 26, characterized in that, the first enclosure part and the second enclosure part are manufactured of different materials.

30. Ear piece according to claim 29, characterized in that, that the first enclosure part is manufactured of hard material and the second enclosure part is manufactured of a soft material.

31. Ear piece according to claim 18, characterized in that, the ear piece is provided with means for removing the ear piece from the ear.

32. Ear piece according to claim 31, characterized in that, the means are a thread attached to the enclosure.

* * * * *